US006358130B1

(12) United States Patent
Freeman et al.

(10) Patent No.: US 6,358,130 B1
(45) Date of Patent: Mar. 19, 2002

(54) POLISHING PAD

(75) Inventors: Peter W. Freeman, Bear; Stanley E. Eppert, Jr., Wilmington, both of DE (US); Alan H. Saikin, Landenberg, PA (US); Marco A. Acevedo, Mesa, AZ (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 09/671,774

(22) Filed: Sep. 28, 2000

Related U.S. Application Data

(60) Provisional application No. 60/156,614, filed on Sep. 29, 1999.

(51) Int. Cl.[7] ..... B24B 29/00

(52) U.S. Cl. ..... 451/285; 451/527; 451/529; 451/530

(58) Field of Search ..... 451/41, 285, 287, 451/288, 526, 527, 529, 530

(56) References Cited

U.S. PATENT DOCUMENTS 5,893,796 A 4/1999 Birang et al.
6,077,783 A * 6/2000 Allman et al. ..... 438/691
6,102,775 A * 8/2000 Ushio et al. ..... 451/6
6,146,248 A * 11/2000 Jairath et al. ..... 451/41
6,190,234 B1 * 2/2001 Swedek et al. ..... 451/6
6,213,845 B1 * 4/2001 Elledge ..... 451/6

FOREIGN PATENT DOCUMENTS

EP 0 663 265 7/1995

* cited by examiner

*Primary Examiner*—Eileen P. Morgan
(74) *Attorney, Agent, or Firm*—Gerald Kita Konrad Kaeding

(57) ABSTRACT

A polishing pad for use with a polishing fluid has, a polishing layer, a window in an opening through the polishing layer, and a fluid impermeable layer spanning across the polishing layer and the window and the opening to provide an uninterrupted continuous barrier to leakage of polishing fluid, the fluid impermeable layer having thereon an adhesive forming bond seals with the polishing layer and the window.

10 Claims, 1 Drawing Sheet

POLISHING PAD

CROSS REFERENCE TO RELATED APPLICATION

This application claims the benefit of U.S. Provisional Patent Application Serial No. 60/156,614 filed on Sep. 29, 1999.

BACKGROUND OF THE INVENTION

Semiconductor wafers having integrated circuits fabricated thereon must be polished to provide a very smooth and flat wafer surface which in some cases may vary from a given plane by as little as a fraction of a micron. Such polishing is usually accomplished in a chemical-mechanical polishing (CMP) operation which utilizes a chemically active slurry that is buffed against the wafer surface by a polishing pad.

U.S. Pat. No. 5,893,796 discloses a polishing pad for use with a polishing fluid, the polishing pad having, a polishing layer and a window in an opening through the polishing layer. The window transmits an optical beam for detection of the presence or absence of a thickness of material being removed from a semiconductor wafer by a CMP polishing operation. One of the problems to be faced is to prevent polishing fluid from leaking beyond the polishing layer and, thereby, causing optical interference with the optical beam being transmitted by the window. To prevent leakage, an adhesive seal is imbedded in the opening between the window and the fluid impermeable layer. However, the seal can be defective by having a leakage path due to a gap in the adhesive seal. Further, the polishing pad is thin and, thereby, is easily bent, which tends to develop a crack or separation of the adhesive from the sides of the opening, due to bending during routine handling of the polishing pad, or due to exertion of polishing pressure during use of the polishing pad, or due to small voids or gaps in the adhesive.

FIELD OF THE INVENTION

The invention relates to a polishing pad having a transparent window through which an optical beam is transmitted for an optical apparatus to detect the status of a workpiece during a polishing operation.

SUMMARY OF THE INVENTION

The invention resides in a polishing pad for use with a polishing fluid, wherein the polishing pad has, a polishing layer, a window in an opening through the polishing layer, and a fluid impermeable layer spanning across the polishing layer and the window and the opening to provide an uninterrupted continuous barrier to leakage of polishing fluid, the fluid impermeable layer having thereon an adhesive that forms bond seals with the polishing layer and the window. An advantage is that the fluid impermeable layer, being uninterrupted, avoids a tendency to produce leakage paths due to bending during routine handling, or due to exertion of polishing pressure during use of the polishing pad, or due to small voids or gaps in the adhesive. A further advantage is that the bond seals minimize wetting by the polishing fluid of the interface between the adhesive and each of the polishing layer, the window and the fluid impermeable layer.

BRIEF DESCRIPTION OF THE DRAWINGS

The invention will now be described by way of example with reference to the accompanying drawings wherein.

DETAILED DESCRIPTION

Figure 2:
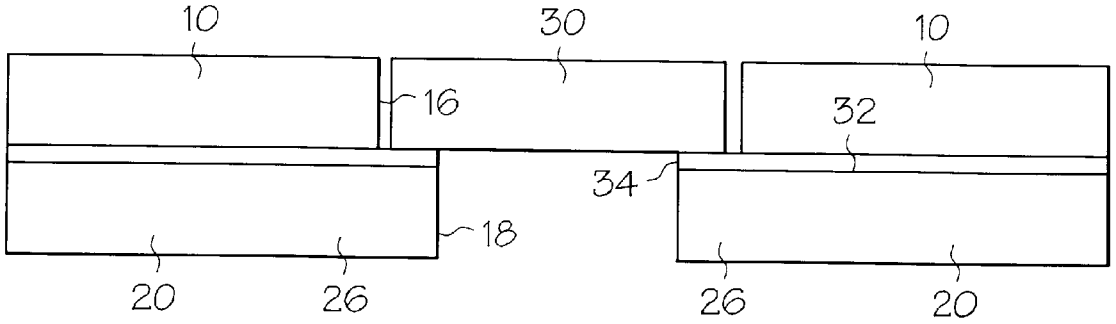
FIG. 2 is an enlarged cross-sectional view through a portion of a polishing pad having a transparent window and an unsuccessful seal.

As shown in FIG. 2, an unsuccessful, polishing pad is a two layer pad that includes an upper polishing layer 10 of IC1000 material and a lower backing layer 20 of Suba IV material, both of which materials are made by Rodel, Inc. The transparent window 30 is made from a piece of optical transmissive polymeric material which is installed in an opening 16 in the polishing layer 10 of the polishing pad. An opening 18 in the lower layer 20 is aligned with and is smaller than the opening 16, thereby forming a ledge 26 that served as a seat for the window 30. A seal was attempted between the window 30 and the ledge 26, which would prevent polishing fluid, in the form of slurry and/or de-ionized water, from leaking past the window 30 and causing interference with an optical beam from optical equipment. Previously, a seal was attempted to be established between the window 30 and the ledge 26 by an adhesive film 32 configured with a cutout 34 which matched the opening 18 in the lower layer 20, and the window piece was sealed by the adhesive seal overlying the ledge 26 on the lower layer 20. However, leakage could still occur if the adhesive seal was defective or became damaged as could occur by bending the polishing pad.

Figure 3:
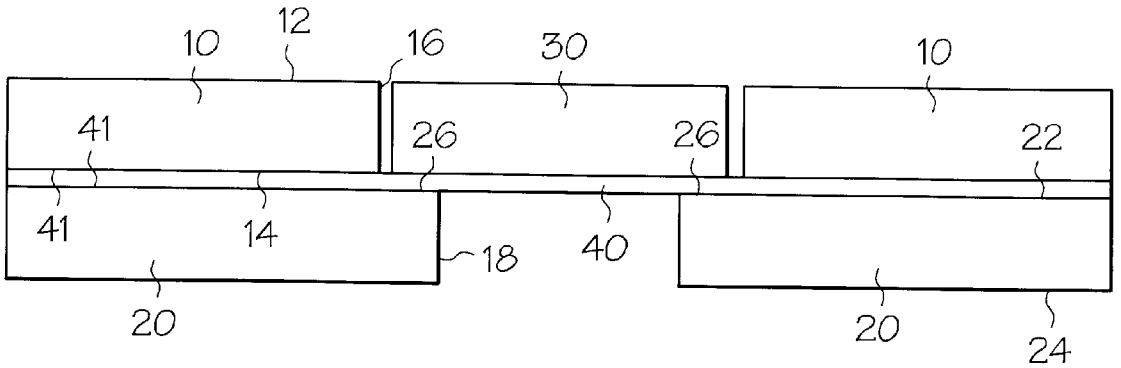
FIG. 3 is an enlarged cross-sectional view of a portion of the polishing pad disclosed in FIG. 1, further disclosing a transparent window and an uninterrupted seal according to the invention.
Figure 1:
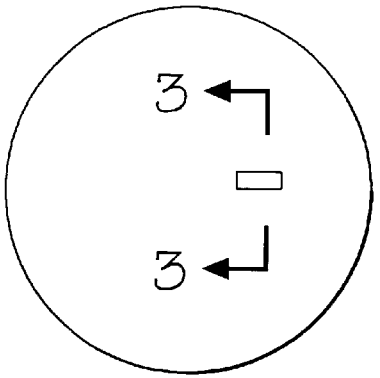
FIG. 1 is a top plan view of a polishing pad having a transparent window.

The invention will be described with reference to FIG. 3. According to an embodiment, the invention provides a polishing pad having a polishing layer 10, and a window 30 in an opening 16 through the polishing layer 10, which are covered by an underlying, continuous, optically transmissive, fluid impermeable layer 40 having adhesive 41 that forms bond seals with the polishing layer 10 and the window 30. The bond seals resist wetting by the polishing fluid of an interface between the adhesive 41 and each of, the polishing layer 10 and the window 30 and the fluid impermeable layer 40.

Another embodiment of the polishing pad 10 according to the invention comprises, a lower backing layer 20, together with, a polishing layer 10 and a window 30 in an opening 16 through the polishing layer 10, which are covered by, and bond sealed to adhesive 41 on both, opposite sides of an underlying, fluid impermeable layer 40. The adhesive 41 on the both sides forms bond seals with the lower backing layer, the polishing layer and the window 30. The backing layer 20 has a top face 22 and a bottom face 24. The bond seals resist wetting by the polishing fluid of an interface between the adhesive 41 and each of, the polishing layer 10, the window 30, the fluid impermeable layer 40 and the backing layer 20. The polishing layer 10 and the backing layer 20 are adhered together by the fluid impermeable layer 40 which includes adhesive 41.

The polishing layer 10 is preferably a layer of IC1000 material, and the backing layer 20 is preferably a layer of Suba IV material, both of which materials are made by Rodel, Inc., of Newark, Del. The polishing layer 10 has a top polishing face 12 and a bottom face 14.

The polishing layer 10 and the backing layer 20 are substantially opaque. A transparent window 30 is disposed in an opening 16 in the polishing layer 10. The transparent window 30 is made of an optically transmissive, or light-transmissive, material to permit an optical beam from a known optical equipment or apparatus to pass through the polishing pad while the polishing pad is being used for polishing a workpiece (not shown). An optically transmissive material is known from U.S. Pat. No. 5,893,796.

The opening 16 extends through the thickness of the polishing layer 10 from the polishing face 12 to the bottom face 14, and the transparent window 30 lies in the opening 16 within this thickness. The opening 16 is axially aligned above an opening 18 extending through the thickness of the backing layer from the top face 22 to the bottom face 24.

The opening 18 is smaller in circumference than the circumference of the opening 16. The backing layer 20 around a periphery of the opening 18 forms a circumferential ledge 26 that serves as a seat for the transparent window 30 and the fluid impermeable layer 40.

According to the invention, the fluid impermeable layer 40 is uninterrupted as it spans an area between the openings 16 and 18 beneath the transparent window 30. By uninterrupted it is meant that the fluid impermeable layer 40 is continuous without an aperture or passageway through which polishing fluid could flow through the layer 40 from the opening 16 to the opening 18.

For example, the fluid impermeable layer 40 comprises a flexible, thin film of optically transmissive hydrophobic polymeric material that is used in minimized thickness to maximize its optical transparency, such as, polyethyleneteraphthalate, which is coated with a thin layer of the adhesive 41 on its opposite major surfaces.

The adhesive 41 is a pressure sensitive adhesive that is hydrophobic, and that is used in minimized thickness to maximize its optical transparency, for example, a synthetic rubber based adhesive from Rodel, Inc., of Newark, Del., and known as 3M442 commercially available from 3M Company, Minneapolis, Minn., USA, and further, for example, an acrylic based adhesive known as Rodel PSA V, Adchem 2019, commercially available from Rodel, Inc. of Newark, Del., and further for example, a metal-free acrylic adhesive known as, Rodel PSA VII, Adhesive Research Development 8049-28, commercially available from Rodel, Inc. of Newark, Del., and further for example, a metal-free acrylic adhesive known as, Rodel PSA VII, Adhesive Research Development 8119-28, commercially available from Rodel, Inc. of Newark, Del. Further, for example, the fluid impermeable layer 40 is fabricated as a film with opposite sides having adhesive 41 permanently adhered to the film, and the adhesive 41 on each of the opposite sides being covered and protected by a peel away covering film, not shown.

The peel away covering film is removed to expose the adhesive 41 on the fluid impermeable layer 40 for application in contact with the bottom face 14 of the polishing layer 10 and the entire bottom surface of the transparent window 30. Pressure is applied to thereby adhere the adhesive 41 to the polishing layer 10 and the window 30 with a water repellant, hydrophobic bond seal. In particular, the adhesive 41 adheres to the bottom face 14, and circumscribes around a periphery of the cutout 16, and also adheres to the entire bottom surface of the transparent window 30. The adhesive 41 on the bottom of the fluid impermeable layer 40 is exposed by removal of the peel away covering film, to adhere the polishing pad to a platen of a known polishing machine, not shown, or to adhere the polishing pad to a backing layer 20.

According to an embodiment, the invention provides a polishing pad having a polishing layer 10, and a window 30 in an opening 16 through the polishing layer 10, which are covered by, and bond sealed to, an underlying, fluid impermeable layer 40 having adhesive 41 on both sides. Polishing fluid, such as slurry or de-ionized water, is delivered to the polishing face 12. The fluid impermeable layer 40 that is adhesively bond sealed to the undersurfaces of the polishing layer 10 and the transparent window 30, serves as an uninterrupted continuous, fluid impermeable barrier to polishing fluid that leaks into the opening 16 around the transparent window 30 or that leaks beneath the polishing layer 10.

If there is any gap in the bond seal provided by the adhesive 41 with either the polishing layer 10 or the window 30, any polishing fluid which leaks through such a gap will be contained against an uninterrupted continuous, fluid impermeable barrier provided by the fluid impermeable layer 40 that covers and spans across the opening 16 and the back face 14 of the polishing layer 10 and the back side of the window 30.

The uninterrupted fluid impermeable layer 40 eliminates reliance upon a seal imbedded in the opening 16 between the window 30 and the polishing layer 10.

Although an embodiment of the invention has been described, other embodiments and modifications are intended to be covered by the spirit and scope of the appended claims.

What is claimed is:

1. A polishing pad for use with a polishing fluid comprising:

a polishing layer and a window in an opening through the polishing layer, the undersurfaces of which are covered by an underlying fluid impermeable layer;

an adhesive on the fluid impermeable layer forming respective bond seals with the polishing layer and the window to resist wetting of an interface between the adhesive and each of, the polishing layer and the window and the fluid impermeable layer;

the fluid impermeable layer spanning the polishing layer;

the fluid impermeable layer being optically transmissive and spanning across the window and the opening; and the fluid impermeable layer being a continuous barrier to leakage of polishing fluid.

2. The polishing pad of claim 1 wherein, the fluid impermeable layer comprises, a flexible thin film of hydrophobic polymeric material.

3. The polishing pad of claim 1 wherein, the adhesive is of minimized thickness to maximize its optical transparency.

4. The polishing pad of claim 1 wherein, the adhesive is a pressure sensitive adhesive that is hydrophobic.

5. The polishing pad of claim 1, and further comprising, a backing layer adhered to the fluid impermeable layer, with the fluid impermeable layer being between the backing layer and the polishing layer, and an opening through the backing layer, the opening through the backing layer being aligned with the window in the opening through the polishing layer.

6. The polishing pad of claim 5 wherein, the backing layer around a periphery of the opening through the backing layer forms a circumferential ledge that serves as a seat for the window and the fluid impermeable layer.

7. The polishing pad of claim 5 wherein, the opening through the backing layer is smaller in circumference than the opening through the polishing layer.

8. The polishing pad of claim 5 wherein, additional adhesive adheres the backing layer to the fluid impermeable layer.

9. The polishing pad of claim 8 wherein, the additional adhesive is of minimized thickness to maximize its optical transparency.

10. The polishing pad of claim 8 wherein, the additional adhesive is a pressure sensitive adhesive that is hydrophobic.

* * * * *